US010077567B2

(12) United States Patent
Andree et al.

(10) Patent No.: US 10,077,567 B2
(45) Date of Patent: Sep. 18, 2018

(54) METHOD FOR REINFORCING AND CALIBRATING A PIPE PORTION

(71) Applicant: Peri GmbH, Weissenhorn (DE)

(72) Inventors: Juergen Andree, Neu-Ulm (DE); Rudolf Specht, Neu-Ulm (DE)

(73) Assignee: PERI GMBH, Weissenhorn (DE)

( * ) Notice: Subject to any disclaimer, the term of this patent is extended or adjusted under 35 U.S.C. 154(b) by 300 days.

(21) Appl. No.: 14/873,387

(22) Filed: Oct. 2, 2015

(65) Prior Publication Data

US 2016/0024808 A1 Jan. 28, 2016

Related U.S. Application Data

(63) Continuation of application No. PCT/EP2014/057242, filed on Apr. 10, 2014.

(51) Int. Cl.

| | |
|---|---|
| ***B21D 41/02*** | (2006.01) |
| ***E04G 25/06*** | (2006.01) |
| ***B21H 3/02*** | (2006.01) |
| ***B21C 1/22*** | (2006.01) |
| ***E04G 17/14*** | (2006.01) |
| *E04G 25/04* | (2006.01) |

(52) U.S. Cl.

CPC ..... *E04G 25/065* (2013.01); *B21C 1/22* (2013.01); *B21D 41/026* (2013.01); *B21H 3/02* (2013.01); *E04G 17/14* (2013.01); *E04G 25/061* (2013.01); *E04G 2025/042* (2013.01)

(58) Field of Classification Search

CPC ..... B21D 41/026

See application file for complete search history.

(56) References Cited

U.S. PATENT DOCUMENTS

| | | | | | |
|---|---|---|---|---|---|
| 1,926,353 | A * | 9/1933 | Spatta | B21D 53/90 | 29/DIG. 43 |
| 1,982,544 | A | 11/1934 | Singer | | |
| 2,081,645 | A * | 5/1937 | Squires | B21D 53/78 | 266/255 |
| 2,329,173 | A * | 9/1943 | Fife | B21C 3/14 | 72/347 |

(Continued)

FOREIGN PATENT DOCUMENTS

| | | | |
|---|---|---|---|
| CN | 1078180 | A | 11/1993 |
| CN | 102459785 | A | 5/2015 |

(Continued)

OTHER PUBLICATIONS

Acrow Formwork & Scaffolding Pty Ltd, Formwork Product Technical Guide for Acrow Prop, Jun. 30, 2012, 6 pages, XP055471378.

(Continued)

*Primary Examiner* — Michael Safavi

(74) *Attorney, Agent, or Firm* — Hackler Daghighian Martino & Novak

(57) ABSTRACT

A method and a device for producing an outer pipe of a telescope-like support, for reasons of weight and stability, is produced from a standardized zinc-coated steel pipe having a large outer diameter and a small wall thickness. Also included is the telescope-like support and the outer pipe which is contained therein. A pipe portion of the outer pipe is expanded in the method with a punch and subsequently tapered to the original outer diameter again with a ring. A reinforcement of the pipe portion and a calibration of the outer diameter of the pipe portion are thereby achieved. An outer thread can be rolled on the pipe portion.

11 Claims, 5 Drawing Sheets

(56) References Cited

U.S. PATENT DOCUMENTS

| | | | | | |
|---|---|---|---|---|---|
| 2,476,656 | A | | 7/1949 | Galbraith | |
| 2,548,444 | A | | 4/1951 | Parker et al. | |
| 2,621,701 | A | | 12/1952 | Galbraith | |
| 3,764,438 | A | * | 10/1973 | Voss et al. | A61F 13/26 118/401 |
| 3,958,819 | A | * | 5/1976 | Tifft | A62C 37/10 239/209 |
| 7,594,332 | B2 | * | 9/2009 | Miki | B21J 5/10 29/898 |
| 7,788,957 | B2 | * | 9/2010 | Okui | B21D 39/20 72/209 |
| 8,074,482 | B2 | * | 12/2011 | Okui | B21C 3/16 72/283 |
| 2013/0340255 | A1 | * | 12/2013 | Samko | B21D 53/02 29/890.053 |

FOREIGN PATENT DOCUMENTS

| | | | | | |
|---|---|---|---|---|---|
| DE | 714 637 | | 12/1941 | | |
| DE | 101 18 032 | A1 | | 10/2002 | |
| DE | 102009038316 | | * | 2/2011 | B21D 41/026 |
| DE | 10 2009 054 628 | A1 | | 6/2011 | |
| DE | 10 2010 038 231 | A1 | | 4/2012 | |
| DE | 102015010343 | A1 | * | 3/2016 | B21D 41/026 |
| JP | S56 105835 | A | | 8/1981 | |
| JP | S57 47662 | U | | 3/1982 | |
| JP | H07 1057 | A | | 1/1995 | |
| JP | H08 117856 | A | | 5/1996 | |
| JP | 2001058211 | A | | 3/2001 | |
| WO | 2010/137984 | A1 | | 12/2010 | |
| WO | 20111082927 | A1 | | 7/2011 | |

OTHER PUBLICATIONS

Deutches Institute Für Bautechnik (DIBT), "Bauaufsichtliche Zulassung Doka-Baustütze Eurex 20 top" (Building Supervision Approval of Doka-Building Support Eurex 20 top), Nov. 18, 2013, 1 page, XP055471540.

* cited by examiner

METHOD FOR REINFORCING AND CALIBRATING A PIPE PORTION

CROSS-REFERENCE TO RELATED APPLICATIONS

This continuation application claims priority to PCT/EP2014/057242 filed on Apr. 10, 2014 which has published as WO 2014/167043 A1 and also the German application number DE 10 2013 206 577.9 filed on Apr. 12, 2013, the entire contents of which are fully incorporated herein with these references.

DESCRIPTION

Field of the Invention

The invention relates to a method for reinforcing and calibrating a thin-walled pipe portion of an outer pipe of a telescope-like support for the construction sector, a device for carrying out the method, a pipe portion of an outer pipe of a telescope-like support produced by the method and a telescope-like support having a thin-walled pipe portion.

Background of the Invention

In the construction sector, telescope-like supports are used for a wide variety of support applications, for example, as ceiling or structural supports for supporting concrete shutterings. The telescope-like supports have an outer pipe and an inner pipe which can be axially displaced relative to the outer pipe. The outer pipe may have a thread on which the inner pipe is supported directly or indirectly. The thread of the outer pipe is generally an outer thread. Such telescope-like supports are disclosed, for example, in DE 10 2009 054 628 A1.

The outer pipes of the telescope-like supports used are generally zinc-coated steel pipes. The thread can be rolled on the zinc-coated steel pipes.

In order to reduce the weight of the outer pipes, with the load-bearing capacity remaining the same, outer pipes having the largest possible outer diameter and a small wall thickness are used.

However, during the production of such outer pipes, it has been found that a thread can be rolled on the outer pipes only with difficulty. The rolled threads do not have the necessary stability to take up the load transmitted to the thread. For example, it has been observed in tests that a nut which is screwed onto an outer thread of an outer pipe "slides through" on the outer thread. In other cases, the thread is torn off during the rolling operation. This is due, on the one hand, to the small wall thicknesses of the pipes used and, on the other hand, to the tolerances in the roundness of the pipe cross-section and the outer diameter of the pipe.

The problem can be overcome by welding a complete threaded piece onto an outer pipe with no thread. However, the weld seam which is produced in this instance may constitute a weak point of the telescope-like support. Furthermore, the weld seam must be subsequently processed in order to ensure adequate corrosion protection.

An object of the present invention is therefore to provide a method for reinforcing and calibrating at least one pipe portion of an outer pipe of a telescope-like support for the construction sector.

SUMMARY OF THE INVENTION

This object is achieved by the method according to claim 1. The methods according to the dependent claims are preferred examples of this method.

Hence, the object is achieved by a method for reinforcing and calibrating of at least a thin-walled pipe portion of an outer pipe of a telescope-like support for the construction sector, the method comprising the steps of: a) pushing a ring onto the pipe portion, whereby the inner diameter of the ring corresponds to the outer diameter of the pipe portion; b) inserting a punch into the pipe portion, the outer diameter of the punch being greater than the inner diameter of the pipe portion thus expanding the pipe portion; c) pulling the punch out of the pipe portion; d) covering the expanded pipe portion with the ring, thus tapering the expanded pipe portion; whereby step d) is performed after step c) or simultaneously with step c).

It is thereby possible in a simple manner to reinforce and calibrate an end portion of a pipe, the pipe used while the method is carried out being able to constantly remain clamped at one side.

Step b) is performed after step a) or simultaneously with step a). Steps c) and d) are performed after steps a) and b).

The method according to the invention can be used on the entire pipe or a pipe portion. The punch can be pushed completely through the pipe. Preferably, the punch is pushed into a pipe portion only partially and pulled out again. In a particularly preferred manner, the punch is pushed approximately 300 mm into the pipe.

The pipe used in the method is consequently expanded by a punch or mandrel which is introduced into the pipe from the inner side. When the pipe portion is expanded, the pipe is preferably expanded by approximately 1 mm, that is to say, the outer diameter increases by approximately 1 mm as a result of the expansion. When the pipe expands, there is a change of structure, which brings about a reinforcement of the expanded pipe portion. Furthermore, owing to the insertion of the punch, there is produced a calibration of the inner diameter of the expanded pipe portion. The inner diameter of the pipe portion is in this instance shaped on the outer diameter of the punch.

In order to facilitate the introduction of the punch, there can be used a punch which has a first chamfer or rounded portion between the front side thereof which protrudes into the pipe first and the outer side thereof which is in abutment with the inner side of the pipe portion.

The withdrawal of the punch from the pipe can be further facilitated when a punch is used which has a second chamfer or rounded portion between the outer side thereof which is in abutment with the inner side of the pipe portion and the rear side thereof which is opposite the front side.

The introduction of the punch is preferably carried out at ambient temperature so that a cold shaping or cold forming of the expanded pipe portion takes place.

Further reinforcement of the pipe and calibration of the outer diameter of the pipe portion processed in the method is carried out in that, after the expansion of the pipe portion, the pipe is at least partially covered by the ring, whose inner diameter is smaller than the outer diameter of the expanded pipe portion. The expanded pipe portion is tapered in this instance by the inner side of the ring, which is pulled over the expanded pipe portion. In this instance, there is produced a structural change of the tapered pipe portion. Owing to the calibrated outer diameter, an outer thread can be fitted to the pipe in a particularly effective manner.

The pulling of the ring over the outer side of the expanded pipe portion is preferably carried out at ambient temperature so that a cold shaping of the pipe portion which is now tapered takes place.

A ring whose inner diameter substantially corresponds to the outer diameter of the pipe portion before the expansion by the punch is used. It is thereby consequently possible to produce a pipe or pipe portion whose outer diameter after the method according to the invention has been carried out corresponds to the outer diameter before the method according to the invention has been carried out. If the method according to the invention is carried out only on a pipe portion, a pipe having a consistent outer diameter at the processed and the unprocessed pipe portion of the pipe can be achieved. At the same time, however, the processed pipe portion is reinforced and the outer diameter thereof is calibrated and the roundness improved.

The tolerance of the outer diameter may in this instance be improved from typically ±0.3 mm to ±0.15 mm.

The method is carried out on the pipe in a particularly simple manner, since the ring is pushed onto the pipe before the punch is inserted and the punch is pulled out of the pipe after it has been inserted into the pipe. Consequently, the method has the following steps:

a) pushing the ring onto the pipe;
b) inserting the punch into the pipe, a pipe portion being expanded;
c) pulling the punch out of the pipe;
d) covering the expanded pipe portion with the ring, the expanded pipe portion again being tapered.

The punch and the ring are preferably guided with fixed spacing with respect to each other. A device for carrying out the method can thereby be constructed in a structurally simple manner. The punch and ring may, for example, be arranged on a common retention member. Alternatively, the punch and the ring can be constructed in an integral manner. The ring is preferably guided approximately 20 mm in front of the punch.

A thread is applied to the reinforced and calibrated pipe portion. The thread is rolled, in particular, in the form of an outer thread. The processed pipe can thereby be used as an outer pipe of a telescope-like support in the construction sector.

In a particularly preferred manner, a thread in the form of a trapezoidal thread having a flank angle of less than 15°, in particular 10°, is rolled on the processed pipe portion. Owing to the small flank angle, a very high load can be transmitted to the thread.

In order to carry out the method, a pipe in the form of a zinc-coated steel pipe can be used. After carrying out the method, such a pipe has at least one processed pipe portion having a high degree of stability, dimensional accuracy and corrosion resistance. Zinc-coated steel pipes are produced with standardized diameters in large quantities and can thereby be coated in a cost-effective manner.

The advantages of the method according to the invention are particularly brought to bear when a pipe having an outer diameter of more than 60 mm and a wall thickness of less than 3 mm, in particular having a wall thickness of less than 2.7 mm, is used to carry out the method. In this instance, threads can also be rolled on these pipes.

Hence, the invention relates to a method for producing an outer pipe of a telescope-like support for the construction sector, at least one pipe portion of the outer pipe being processed with a method described above.

The invention further relates to a device for carrying out a method described above, having a clamping device for securely receiving a pipe, a punch which is round in cross-section and which can be pressed into the pipe in the longitudinal direction of a clamped pipe and a ring which can be pulled over the outer side of the pipe in the longitudinal direction of the clamped pipe.

The ring preferably has—besides one or two chamfers or rounded portions at the end of the ring—a consistent inner diameter. Thus, the ring can be manufactured in an easy and low-priced way and allows for the production of a high-quality outer surface of the pipe portion, which is treated by the method.

The punch can preferably be moved together with the ring along the longitudinal axis of a clamped pipe. A control of the method carried out with the device can thereby be simplified.

In a particularly preferred embodiment of the invention, the punch is connected to the ring. The device can thereby be constructed in a structurally particularly simple manner. Preferably, the connection between the punch and the ring is direct and rigid.

The invention further relates to an outer pipe of a telescope-like support for the construction sector, the outer pipe being constructed integrally with a continuous outer diameter and having at least partially an outer thread which is rolled on the outer covering face thereof and/or an inner thread which is rolled on the inner covering face thereof, the ratio of the outer diameter of the outer pipe to the wall thickness of the outer pipe being greater than 26.2.

Integral outer pipes of telescope-like supports having a continuous outer diameter and such a large outer diameter-to-wall thickness ratio are both very light and extremely stable. The production of such outer pipes is carried out at least partially using the method described above.

The outer pipe preferably comprises zinc-coated steel. Zinc-coated steel is corrosion-resistant, stable and comparatively cost-effective.

In a particularly preferred embodiment of the invention, the outer diameter of the outer pipe is greater than 60.3 mm, that is to say, it is suitable for loads of more than 30 kN. The outer pipe is thereby constructed in a particularly stable and light manner. The cross-section surface-area of the outer pipe is preferably always greater than 419 $mm^2$.

The invention finally relates to a telescope-like support for the construction sector having an outer pipe described above and an inner pipe which is arranged so as to be able to be axially displaced therein.

In the telescope-like support according to the invention, a stop element may be provided according to the invention in the region of an end of the outer pipe, the stop element at least partially covering the free cross-section surface-area of the outer pipe. The term "covering the cross-section surface-area" in the present application is also intended to be understood to mean an at least partial protrusion of the stop element into the free cross-section of the outer pipe. The advantage substantially involves the stop element being able to be arranged in a simple manner on the outer pipe, without a complex modification of the inner cross-section of the outer pipe or welding of separate pipe pieces being required for this purpose. Depending on the type of fixing selected, an action for limiting the withdrawal of the inner pipe, which action is robust and highly resilient with respect to axially acting forces, can be achieved. The stop element according to the invention is preferably secured to the outer pipe without any separate connection means and in the simplest case is simply arranged with press-fitting on or in the outer pipe. However, the stop element may also be arranged in the manner of a snap ring in a groove which is arranged on the outer pipe or be arranged on the outer pipe by means of a catch connection or a bayonet-closure type fixing. The stop element is connected to the outer pipe in the region of the free end of the outer pipe.

According to a preferred development of the invention, the stop element engages in an inner and/or outer thread of the outer pipe which is arranged on a covering face of the outer pipe, a particularly resilient arrangement of the stop element being achieved in that the stop element engages with an outer and/or an inner thread in the corresponding threads(s) of the outer pipe.

In order to secure the stop element with respect to unintentional release from the assembly position thereof, it has been found to be advantageous in practice for a rotation prevention means to be associated with the stop element. The rotation prevention means may in particular have a securing flap which is arranged on the stop element and which can be hammered into the thread of the outer pipe. The stop element, in this instance a hammering flap, engages in a through-opening of the outer pipe.

The resilience of the stop element with respect to axial loads, as may occur in particular when a contaminated inner pipe is inserted into the outer pipe, is further improved in that the stop element at least partially covers an end face, that is to say, an end-side wall portion, of one end of the outer pipe.

According to an embodiment of the invention, the stop element is preferably constructed as a cap or a sleeve. On the one hand, it is thereby possible to counteract the introduction of contaminants, for example, fresh concrete, into the inner side of the outer pipe, which is advantageous for low-maintenance and reliable function. On the other hand, the stop element can thereby act as a (plain) bearing and at the same time as a wiping element for a contaminated inner pipe. If the stop element is constructed as a cap or a sleeve, no additional processing has to take place in order to produce a stop element on the outer pipe.

In order to achieve a function of the falling-out prevention means which is independent of the orientation of the inner pipe in the outer pipe, the stop means of the inner pipe is preferably constructed as an expanded, for example beaded, end of the inner pipe. The inner pipe cannot thereby be removed from the outer pipe, even in the event of very great, acting forces, as may occur in practice.

So that the stop element, even under high bending torques of the withdrawn inner pipe, cannot be released from the assembled position thereof, according to a development of the invention the inner pipe has at least one projection which laterally protrudes radially over the outer covering face thereof and which is arranged with axial spacing from the expanded end of the inner pipe, the stop means. The projection in this instance is preferably constructed integrally with the inner pipe and in particular produced by means of a shaping process on the inner pipe. The projection is advantageously constructed in the form of a knob or crimped projection and can extend in the peripheral direction of the inner pipe over a preferably large peripheral angle. According to an embodiment of the invention, a plurality of projections may also be provided and are aligned along the outer periphery of the inner pipe with spacing from each other and which are preferably arranged in a plane which is arranged in an orthogonal manner with respect to the longitudinal axis of the inner pipe.

For the purposes of improved positioning precision and reliable support behavior, the inner pipe is guided axially on the stop element and/or on an inner covering face of the outer pipe, preferably with a positive-locking connection having sliding play. In this instance, the inner pipe is advantageously guided on the inner covering face of the outer pipe with one stop means, in this instance, for example, with the beaded edge of the end thereof arranged in the outer pipe, and/or with the at least one projection.

According to a development of the invention which is particularly preferred in terms of technical production aspects, the stop element which is preferably constructed as a cap has an inner thread which engages in an outer thread of the outer pipe, the outer thread additionally being in engagement with an inner thread of a recessed nut on which a securing pin which can be guided transversely relative to the longitudinal axis of the telescope-like support through the outer and inner pipe can be supported. On the one hand, fine adjustment of the functional overall length of the telescope-like support and easier paneling are thereby possible and, on the other hand, the stop element can be screwed directly onto a thread which is provided in any case. At the same time, the stop element acts in this instance as a counter-nut or a stop element for the recessed nut so that it is arranged on the telescope-like support in a non-releasable manner.

With regard to a particularly cost-effective production of the telescope-like support, the outer pipe preferably has an inner diameter which is substantially consistent over the entire axial length thereof.

In the case of an at least partial expansion of the outer pipe by the stamp, however, the outer pipe may also have a partially expanded inner diameter.

On the whole, the structural support (telescope-like support) described has the advantage that it can be assembled (final assembly) in an extremely simple manner. The outer and inner pipe can be processed and produced without additional elements and only when the outer and inner pipe are joined together is the recessed nut screwed onto the outer pipe with the elements which are connected thereto. The securing pin is also fitted to the outer pipe before the inner pipe is joined together with the outer pipe. If the structural support is joined together in accordance with the invention, the securing pin can be used in the region of the through-opening only as long as the stop element has an outer diameter which is greater than the clear width of a portion of the correspondingly formed securing pin, which portion surrounds the outer pipe.

Other features and advantages of the invention will be appreciated from the following detailed description of an embodiment of the invention, with reference to the Figures of the drawings, which description sets out details which are significant to the invention, and from the claims.

The features illustrated in the drawings are not necessarily intended to be understood to be drawn to scale and are illustrated in such a manner that the specific features according to the invention can be made clearly visible. The various features can be implemented individually per se or together in any combination in variants of the invention.

An embodiment of a telescope-like support according to the invention having an outer pipe according to the invention and a portion of the production process of the outer pipe are illustrated in the schematic drawings and are explained in greater detail in the following description.

DETAILED DESCRIPTION OF THE PREFERRED EMBODIMENTS

Figure 1:
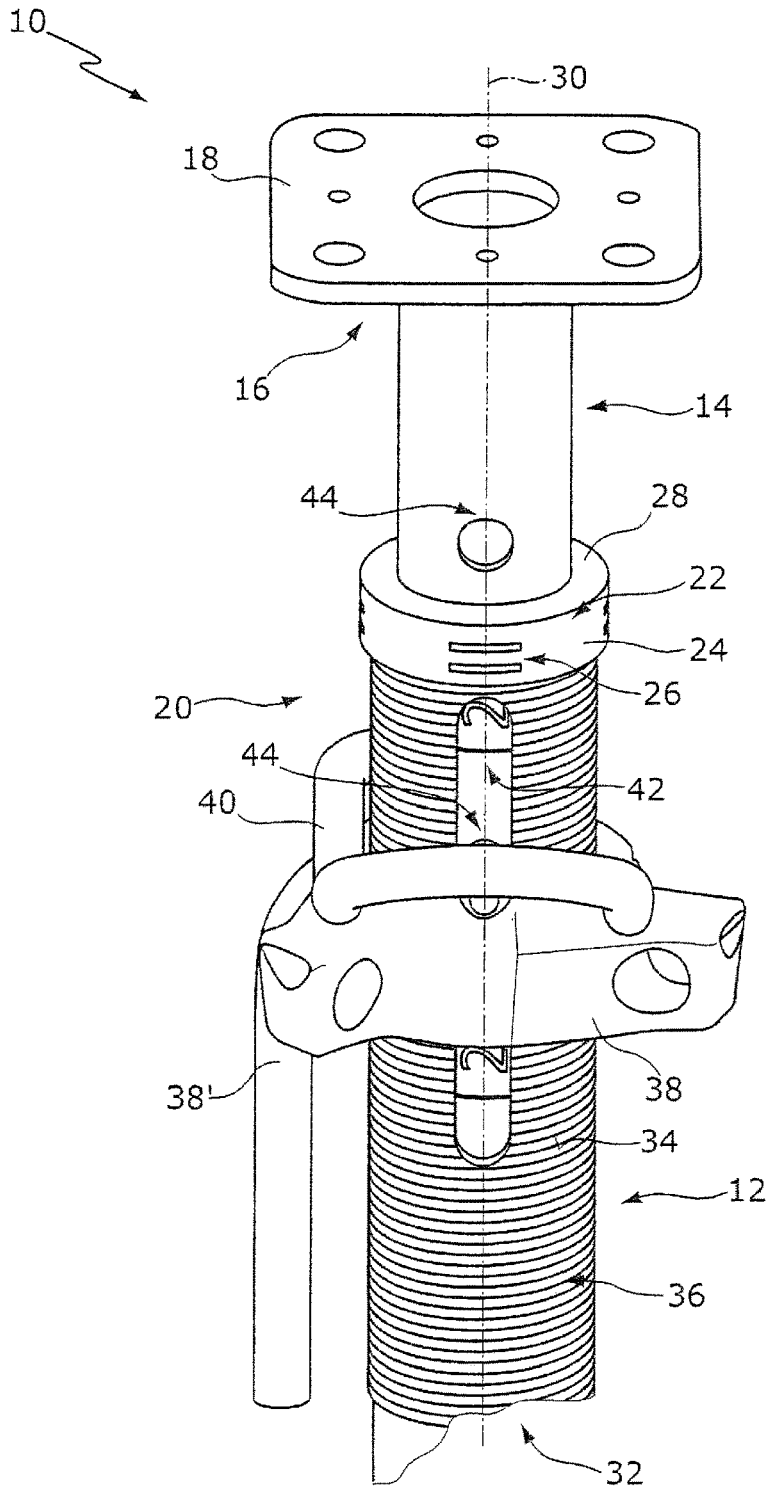
FIG. 1 is a perspective cut-out of a telescope-like support according to the invention having an outer pipe and a stop element which is constructed as a cap.

FIG. 1 shows a selected support portion of a telescope-like support according to the invention for the construction sector, which support is generally designated 10. The telescope-like support 10 has an outer pipe 12 according to the invention and an inner pipe 14 which is arranged so as to be able to be axially displaced therein. The inner pipe 14 has at the free end 16 thereof illustrated at the top in the Figure a carrier plate 18 known per se whilst the outer pipe 12 has at the foot-side end not illustrated in greater detail in the Figure a foot plate for secure positioning on a respective substrate.

At an upper end 20 of the outer pipe 12, that is to say, an end facing the carrier plate 18 of the inner pipe 14, there is arranged a cap 22 which acts as a stop element for the inner pipe 14 and by means of which the inner pipe 14 is prevented from being axially removed from or falling out of the outer pipe 12.

The cap 22 is constructed in a manner corresponding to a union nut and has a substantially cylindrical wall portion 24 having an inner thread 26. The cylindrical wall portion 24 is adjoined by an edge region 28 of the cap 22, which region 28 is arranged in the Figure above the cylindrical wall portion 24, is angled with respect to the cylindrical wall portion 24 radially in the direction towards a longitudinal axis 30 of the telescope-like support 10 and partially covers a free cross-section surface-area 32 of the outer pipe 12.

The cap 22 or the inner thread 26 thereof is located in engagement with an outer thread 36 which is arranged on the outer covering face 34 of the outer pipe 12. At the same time, there engages in the outer thread 36 of the outer pipe 12 a so-called recessed nut 38 on which a handle 38' is pivotably arranged and which can be moved axially along the outer pipe 12 by means of rotation about the longitudinal axis 30 of the telescope-like support 10.

There is supported on the recessed nut 38 a securing pin 40 which is inserted transversely relative to the longitudinal axis 30 of the telescope-like support 10 through the outer and inner pipe 12, 14. In this regard, the outer pipe 12 has two mutually opposed, elongate first insertion openings which extend parallel with the longitudinal axis 30 of the telescope-like support 10, whilst the inner pipe 14 has a plurality of circular, mutually opposed (aligned) second insertion openings 44 which are arranged along the inner pipe 14 with regular spacing from each other above or below each other, respectively.

For approximate length adjustment of the telescope-like support 10, the inner pipe 14 is first withdrawn as far as a desired length of the telescope-like support 10 and the securing pin 10 is subsequently inserted through the first insertion openings 42 of the outer pipe and second insertion openings 44 of the inner pipe 14 which are in alignment therewith.

By rotating the recessed nut 38 which is arranged below the securing pin 40 in the Figure, the relative position thereof along the outer pipe 12 can subsequently be adjusted in a stepless manner. At the same time, the axial support position of the securing pin 40 on the outer pipe 12 or the inner pipe 14 which is coupled thereto along the outer pipe 12, that is to say, the length of the telescope-like support 10, can thereby be finely adjusted in accordance with requirements.

Figure 2:
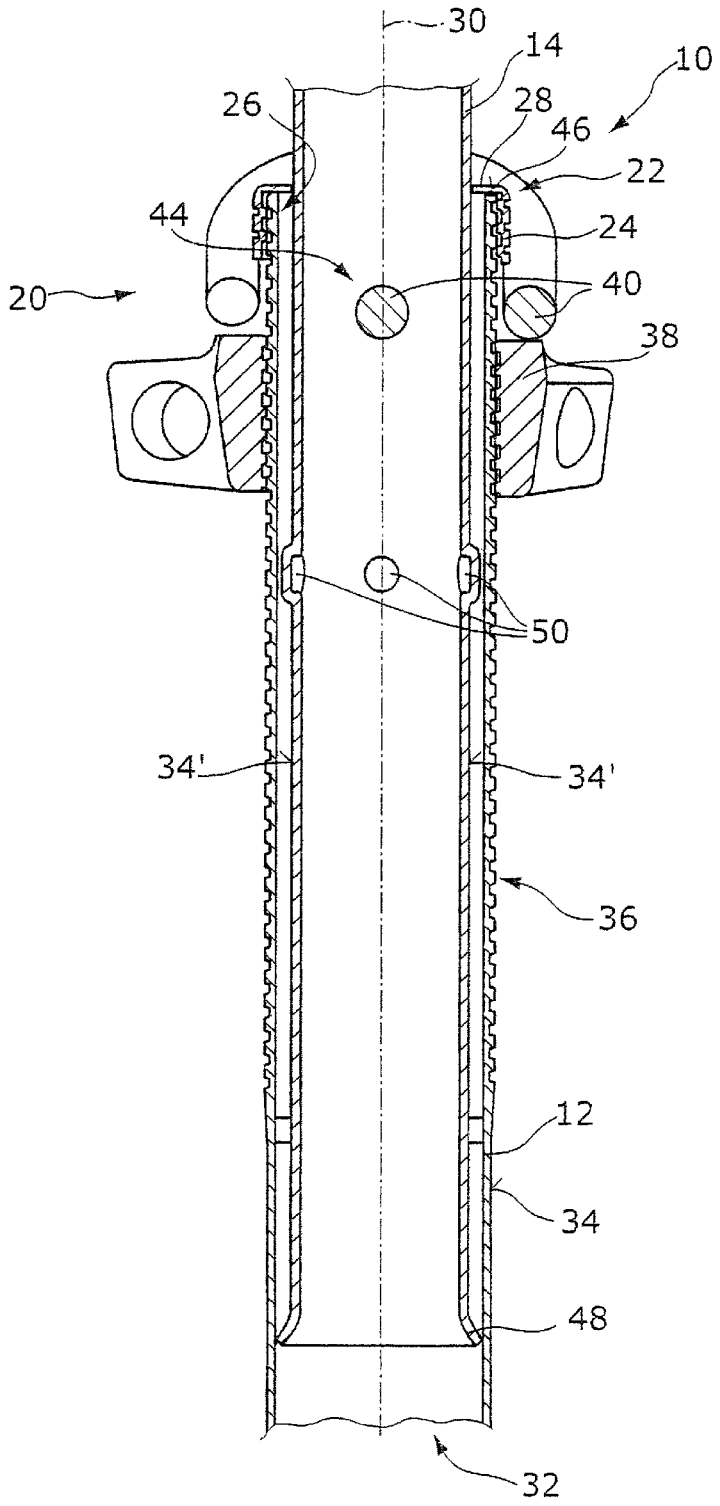
FIG. 2 is a cut-out of a longitudinal section through a telescope-like support which corresponds to FIG. 1.

As can be seen in particular in FIG. 2, a longitudinal section over a part-region of the telescope-like support 10, the cap 22 covers with the angled edge region thereof an end face 46 of one end 20 of the outer pipe 12. The inner pipe 14 has a stop means 48 which is constructed as an expanded end and which can be brought into abutment with the cap 22 or the angled edge region 28 thereof in order to prevent the inner pipe 14 from falling out of the outer pipe 12 if no other securing elements are effective.

The inner pipe 14 additionally has a plurality of knob-like projections 50 which are arranged with spacing from the stop means (expanded end) 48 of the inner pipe 14 and which protrude laterally in a radial direction over an outer covering face 34' of the inner pipe 14. The knob-like projections 50, when a predetermined maximum withdrawal extent of the inner pipe 14 is reached, are brought into abutment with the cap 22 and thus necessitate a minimum length of the inner pipe 14 remaining in the outer pipe 12. In the event of bending torques occurring, the inner pipe 14 is therefore supported on an inner covering face 52 of the outer pipe 12, whereby the cap 22 can be reliably prevented from being levered off the outer pipe 12.

The knob-like projections 50 have a function similar to the stop means 48 and limit the telescoping length of the telescope-like support.

Figure 3:
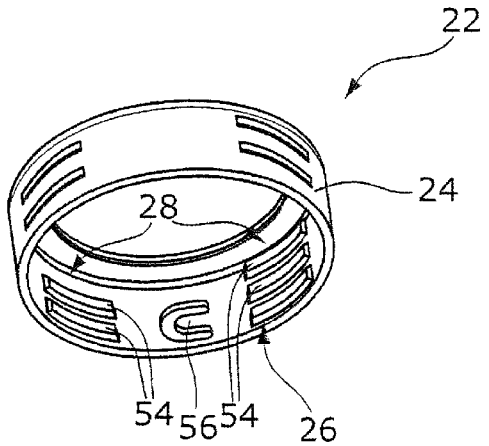
FIG. 3 is a perspective view of the cap from FIG. 1.
Figure 4:
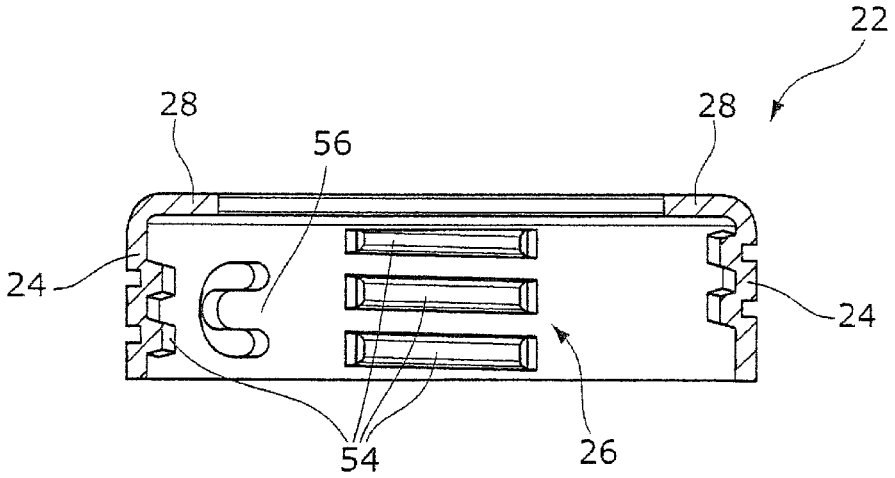
FIG. 4 is a sectioned view of the cap shown in FIG. 3.

The inner thread 26 of the cap 22, as shown in greater detail in FIGS. 3 and 4, is constructed as a flat profile and has a thread profile 54 which is interrupted along the thread.

The illustration in FIG. 4 shows that there is arranged on the cylindrical cap portion 24 of the cap 22 a rotation prevention means 56 which is constructed as a hammering flap and which, after the cap has been screwed onto the outer thread 36 (FIGS. 1 and 2) of the outer pipe 12, is hammered into the outer thread 36 of the outer pipe 12 and which securely engages in an opening 57 (see FIG. 5) in the outer thread 36 of the outer pipe 12.

Figures 5A, 5B, 5C:
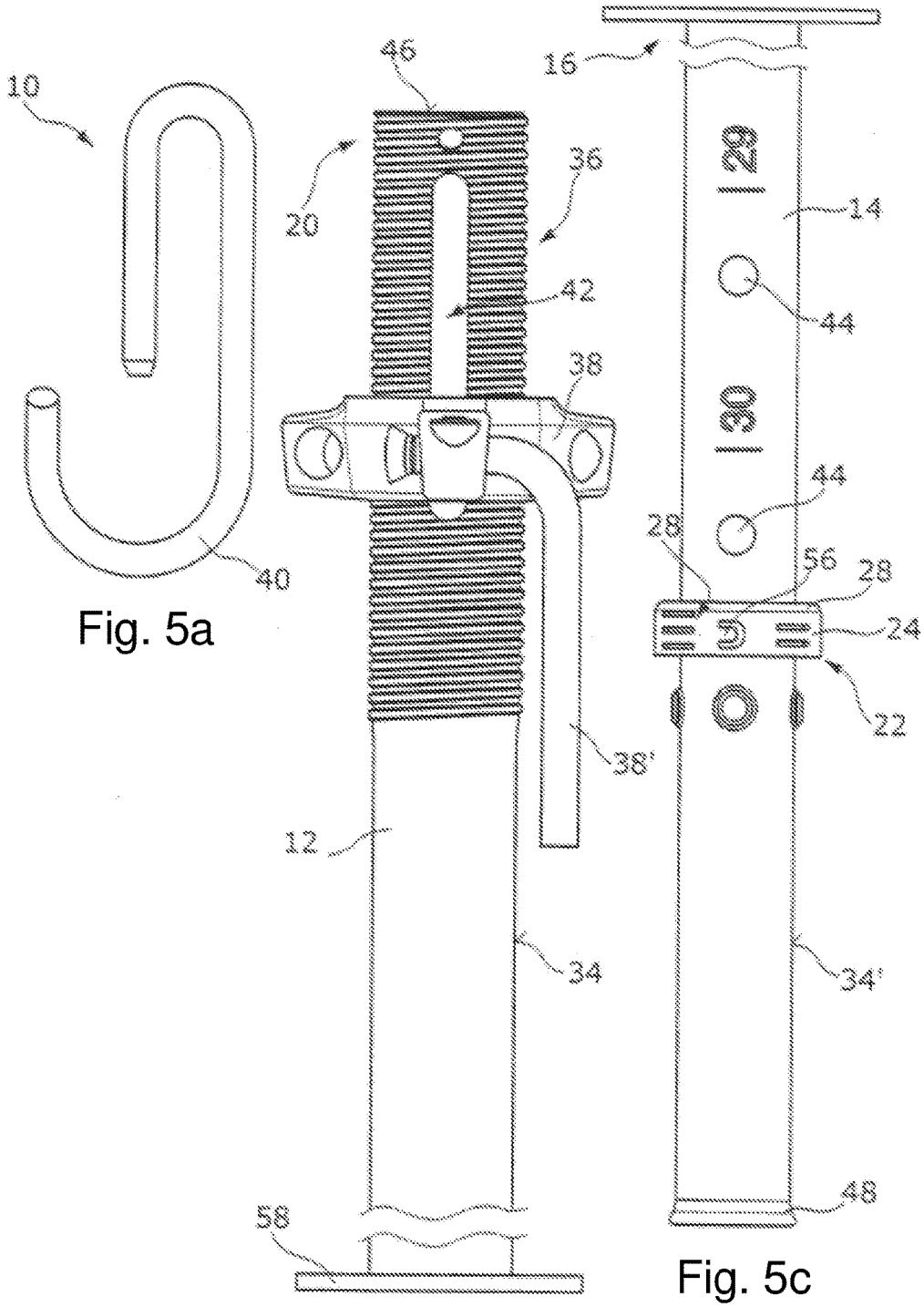
FIGS. 5*a*, 5*b* and 5*c* shows the individual portions of the telescope-like support according to the invention before the inner pipe is joined together with the outer pipe.

FIGS. 5*a*, 5*b* and 5*c* shows the individual components of the telescope-like support 10 according to the invention before the inner pipe 14 is joined together with the outer pipe 12. In particular FIG. 5*a* shows the securing pin 40, FIG. 5*b* shows the outer pipe 12 and FIG. 5*c* shows the inner pin 14. The support plate 18 explained above is already welded to the inner pipe 14, whilst a foot plate 58 is welded to the foot-side end of the outer pipe 12. The recessed nut 38 is screwed to the outer thread 36 of the outer pipe 12, whilst the cap 22 is pushed onto the inner pipe 14 and prevented from being axially removed from the inner pipe 14 by the knob-like projections 50 or the carrier plate 18. In order to join the inner pipe 14 to the outer pipe 12, the inner pipe 14 is inserted axially into the outer pipe 12 with the expanded end 48 thereof (stop means) at the head-side end 20 of the outer pipe 12 until at least the knob-like projections 50 come to rest inside the outer pipe 12. Subsequently, the cap 22 is screwed onto the outer thread 36 of the outer pipe 12 and the insertion flap 56 is hammered with a tool into the opening 57 of the outer pipe 12.

Figure 6A:
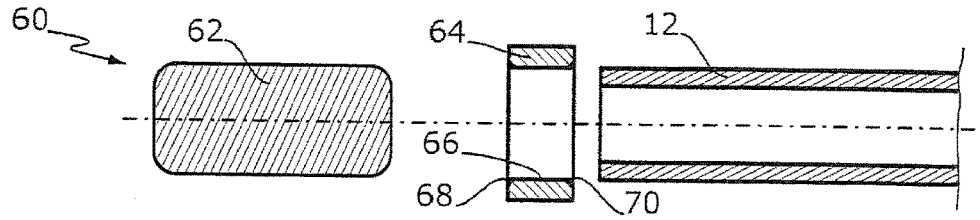
FIG. 6*a* is a sectioned side view of a device for producing the outer pipe in a first position.

FIG. 6*a* is a sectioned side view of a device 60 for carrying out a method according to the invention for producing the outer pipe 12. The device 60 is illustrated in a first position. The device 60 is illustrated in a highly simplified and schematic manner. Guides, drives and the like of the device 60 have not been illustrated for reasons of clarity.

The outer pipe 12 is in an unprocessed state in FIG. 6*a*. The outer pipe 12 may be a zinc-coated steel pipe having an outer diameter of over 60.3 mm, in particular 71 mm, 76.5 mm, 83 mm or 83.5 mm, and a wall thickness of 2.6 mm. The outer pipe is clamped at the right-hand side in a clamping device (not illustrated) of the device 60.

The outer thread 36 (see FIGS. 1, 2, 5) of the outer pipe 12 could not be rolled in the state of the outer pipe 12 illustrated in FIG. 6*a* since the ratio of the outer diameter to the wall thickness and the tolerance of the outer diameter of the outer pipe is too great in this regard in the case of the outer diameter and wall thicknesses set out. In the method according to the invention which is illustrated in FIGS. 6*a* to 6*d*, the outer pipe 12 is therefore reinforced in the region of the shaping and the outer diameter is calibrated, that is to say, the tolerance of the outer diameter is reduced.

To this end, the device 60 has according to FIG. 6*a* a punch 62 and a ring 64. The punch 62 and the ring 64 are constructed so as to be rotationally symmetrical with respect to the longitudinal axis of the outer pipe 12 illustrated with dot-dash lines. The inner diameter of the inner covering face 66 of the ring 64 corresponds to the calibrated outer diameter, that is to say, the outer diameter of the outer pipe 12 to be obtained. Furthermore, the inner covering face 66 of the ring 64 is constructed in a circular manner in order to achieve improved roundness of the outer covering face of the outer pipe 12.

The ring 64 has a first rounded portion 68 and a second rounded portion 70 in order to be able to be better guided over the outer pipe 12.

Figure 6B:
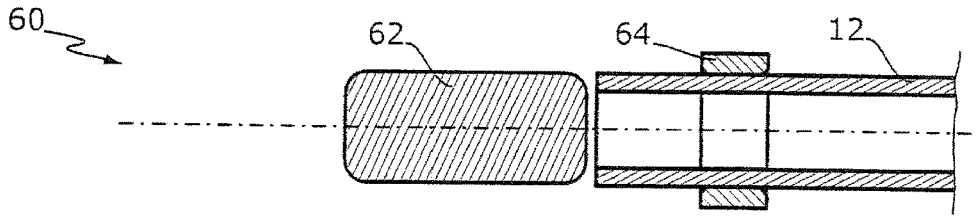
FIG. 6*b* shows the device for producing the outer pipe in a second position.

FIG. 6*b* shows the device 60 in a second position. The punch 62 and the ring 64 are pushed together to the right in this illustration. The punch 62 is connected to the ring 64 in this instance. The connection between the punch 62 and the ring 64 is not illustrated in the illustrations of FIGS. 6*a*-6*d* for reasons of clarity. The inner diameter of the ring 64 substantially corresponds to the outer diameter of the unprocessed outer pipe 12. The ring 64 can therefore be pushed onto the outer pipe 12 with little application of force.

Figure 6C:
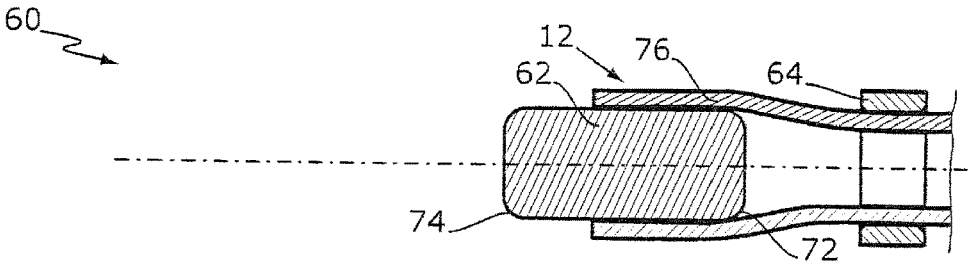
FIG. 6*c* shows the device for producing the outer pipe in a third position.

FIG. 6*c* shows the device 60 in a third position. The punch 62 has been partially introduced into the outer pipe 12 under the application of force. In order to make it easier to introduce the punch 62, it has a third rounded portion 72. When the punch 62 has been introduced to a great extent into the outer pipe 12, a fourth rounded portion 74 enables easy extraction from the outer pipe 12 (not shown). Owing to the introduction of the punch 62, the outer pipe 12 is expanded in a first pipe portion 76 by cold shaping. The first pipe portion 76 thereby becomes slightly longer and the wall thickness in the first pipe portion 76 somewhat smaller.

Figure 6D:
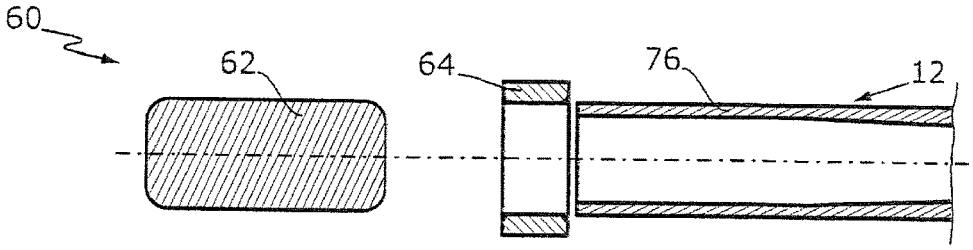
FIG. 6*d* shows the device for producing the outer pipe in a fourth position.

FIG. 6*d* shows the device 60 in a fourth position. The punch 62 has been moved together with the ring 64 to the left away from the outer pipe 12. In this instance, the ring 64 has been pulled over the expanded first pipe portion 76 with the application of force. The outer diameter of the expanded first pipe portion 76 has thereby again been tapered to the original outer diameter of the pipe 12 according to FIG. 6*a*. The roundness and tolerance of the outer diameter was improved in this instance. The tapering further brings about a cold shaping of the first pipe portion 76. A further reinforcement of the first pipe portion 76 is thereby achieved. The wall thickness of the first pipe portion 76 was decreased, whereas the length of the outer pipe 12 was increased.

The device 60 in FIG. 6*d* is in the same position as in FIG. 6*a*. FIGS. 6*a* to 6*d* therefore show a complete cycle of the previously described method. Such a cycle lasts approximately 8 seconds, the punch 62 being introduced approximately 300 mm into the pipe portion 76.

Owing to the processing of the first pipe portion 76, the outer thread 36 can now be readily rolled on the first pipe portion 76.

Figure 6E:
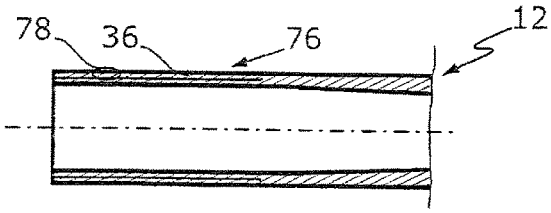
FIG. 6*e* shows the outer pipe from FIG. 6*d* having a thread.

FIG. 6*e* shows the outer pipe 12, the first pipe portion 76 having the outer thread 36. The outer thread 36 was rolled on the first pipe portion 76. In FIG. 6*e*, a cut-out 78 of the outer thread 36 is indicated.

Figure 6F:
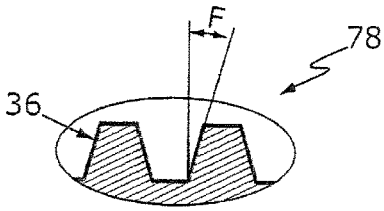
FIG. 6*f* is a cut-out from FIG. 6*e*.

FIG. 6*f* shows the cut-out 78 of the outer thread 36 from FIG. 6*e*. From FIG. 6*f*, it can be seen that the outer thread 36 has a flank angle F. The flank angle F is 10° (for reasons of clarity, a larger angle is shown in the drawing). Owing to the small flank angle of less than 15°, fewer inwardly directed radial forces have to be taken up by the outer pipe 12 when the outer thread 36 is subjected to loading.

In summary, the invention relates to a method and a device for producing an outer pipe of a telescope-like support and the telescope-like support and the outer pipe which is contained therein. For reasons of weight and stability, the outer pipe can be produced from a standardized zinc-coated steel pipe having a large outer diameter and a small wall thickness. A pipe portion of the outer pipe is expanded in the method with a punch and subsequently tapered to the original outer diameter again with a ring. A reinforcement of the pipe portion and a calibration of the outer diameter of the pipe portion are thereby achieved. An outer thread can be rolled on the pipe portion.

What is claimed is:

1. A method for reinforcing and calibrating of at least a thin-walled pipe portion of an outer pipe of a telescope-like support for the construction sector, comprises the steps of:

a) pushing a ring onto the pipe portion, whereby the inner diameter of the ring corresponds to the outer diameter of the pipe portion;

b) inserting a punch into the pipe portion, the outer diameter of the punch being greater than the inner diameter of the pipe portion thus expanding the pipe portion;

c) pulling the punch out of the pipe portion;

d) covering the expanded pipe portion with the ring, thus tapering the expanded pipe portion;

wherein step d) is performed after step c) or simultaneously with step c); and e) rolling a thread in the form of a trapezoidal thread having a flank angle of less than 15° at least partially on the pipe portion.

2. The method according to claim 1, wherein the punch and the ring are guided with fixed spacing with respect to each other.

3. The method according to claim 1, wherein the outer pipe in the form of a zinc-coated steel pipe is used to carry out the method.

4. The method according to claim 1, wherein the outer pipe having an outer diameter of more than 60 mm and a wall thickness of less than 3 mm is used to carry out the method.

5. The method according to claim 1, wherein the outer pipe having an outer diameter of more than 60 mm and a wall thickness of less than 2.7 mm is used to carry out the method.

6. A method for reinforcing and calibrating of at least a thin-walled pipe portion of an outer pipe of a telescope-like support for the construction sector, comprises the steps of:

a) pushing a ring onto the pipe portion, whereby the inner diameter of the ring corresponds to the outer diameter of the pipe portion;

b) inserting a punch into the pipe portion, the outer diameter of the punch being greater than the inner diameter of the pipe portion thus expanding the pipe portion;

c) pulling the punch out of the pipe portion;

d) covering the expanded pipe portion with the ring, thus tapering the expanded pipe portion;

wherein step d) is performed after step c) or simultaneously with step c); and e) rolling a thread in the form of a trapezoidal thread having a flank angle of less than 10° at least partially on the pipe portion.

7. The method according to claim 6, wherein the punch and the ring are guided with fixed spacing with respect to each other.

8. The method according to claim 6, wherein the outer pipe in the form of a zinc-coated steel pipe is used to carry out the method.

9. The method according to claim 6, wherein the outer pipe having an outer diameter of more than 60 mm and a wall thickness of less than 3 mm is used to carry out the method.

10. The method according to claim 6, wherein the outer pipe having an outer diameter of more than 60 mm and a wall thickness of less than 2.7 mm is used to carry out the method.

11. A method for reinforcing and calibrating of at least a thin-walled pipe portion of an outer pipe of a telescope-like support for the construction sector, comprises the steps of:

a) inserting a punch into the pipe portion, the outer diameter of the punch being greater than the inner diameter of the pipe portion thus expanding the pipe portion;

b) pulling the punch out of the pipe portion;

c) covering the expanded pipe portion with a ring thus tapering the expanded pipe portion, where the inner diameter of the ring corresponds to the outer diameter of the pipe portion before it was expanded;

wherein step c) is performed after step b) or simultaneously with step b); and d) rolling a thread in the form of a trapezoidal thread having a flank angle of less than 15° at least partially on the pipe portion.

* * * * *